US012276116B2

(12) United States Patent
Spodar et al.

(10) Patent No.: US 12,276,116 B2
(45) Date of Patent: Apr. 15, 2025

(54) CLADDING SYSTEM FOR A WALL, ARRANGEMENT OF TILE CLADDING SYSTEM AND METHOD FOR MOUNTING THE CLADDING SYSTEM

(71) Applicant: 3A COMPOSITES GMBH, Osnabrück (DE)

(72) Inventors: Vincent Spodar, Jestetten (DE); Amin Emami, Singen (DE); Yasar Tikves, Singen (DE); Klaus Wetzstein, Büßlingen (DE); Tobias Lüdeke, Constance (DE)

(73) Assignee: 3A COMPOSITES GMBH, Osnabrück (DE)

( * ) Notice: Subject to any disclaimer, the term of this patent is extended or adjusted under 35 U.S.C. 154(b) by 581 days.

(21) Appl. No.: 17/414,900

(22) PCT Filed: Oct. 25, 2019

(86) PCT No.: PCT/EP2019/079277
§ 371 (c)(1),
(2) Date: Jun. 16, 2021

(87) PCT Pub. No.: WO2020/084143
PCT Pub. Date: Apr. 30, 2020

(65) Prior Publication Data

US 2022/0064962 A1 Mar. 3, 2022

(30) Foreign Application Priority Data

Oct. 25, 2018 (DE) ..... 10 2018 126 669.3

(51) Int. Cl.
*E04F 13/12* (2006.01)
*E04F 13/08* (2006.01)

(52) U.S. Cl.
CPC ..... *E04F 13/12* (2013.01); *E04F 13/083* (2013.01); *E04F 13/0841* (2013.01);
(Continued)

(58) Field of Classification Search
CPC ..... E04F 13/12; E04F 13/083; E04F 13/0841; E04F 13/0851; E04F 13/086;
(Continued)

(56) References Cited

U.S. PATENT DOCUMENTS 2,082,241 A * 6/1937 Bennett ..... E04F 13/0801 52/387
2,206,201 A * 7/1940 Plym ..... E04F 13/0842 52/393

(Continued)

FOREIGN PATENT DOCUMENTS

AT 506954 A4 * 1/2010 ..... E04F 13/0803
CH 687552 A5 * 12/1996 ..... E04F 13/0864

(Continued)

OTHER PUBLICATIONS

Machine translation of FR 2949134 A1 obtained by the European Patent Office (last accessed on Sep. 27, 2023) (Year: 2011).*

(Continued)

*Primary Examiner* — Ryan D Kwiecinski
(74) *Attorney, Agent, or Firm* — Moore & Van Allen PLLC

(57) ABSTRACT

The invention relates to a cladding system (100) for a wall (1), having a plate-shaped cladding element (50) which can be connected on two opposite longitudinal or transverse sides to a respective fastening profile (10), wherein the fastening profile (10) is designed to anchor the cladding system (100) on the wall (1), wherein the cladding element (50) has, on the two longitudinal or transverse sides arranged in operative connection with a fastening profile (10), in each (Continued)

Figure 1:
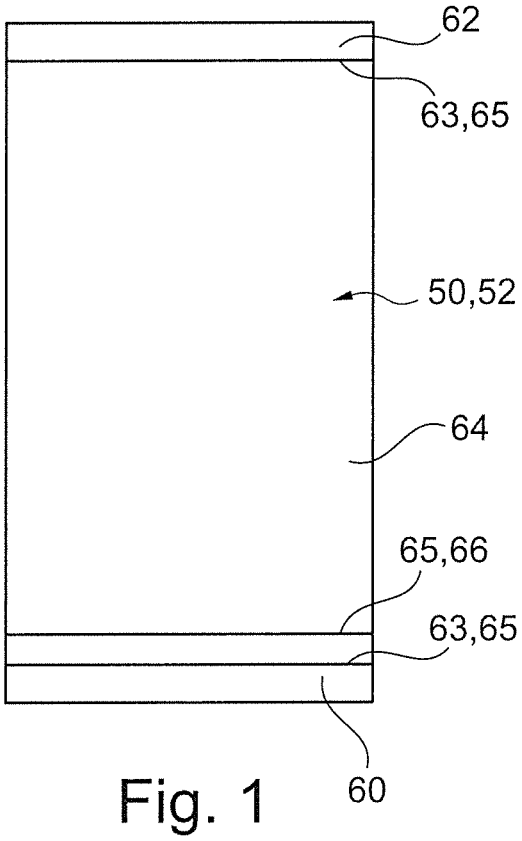

case a preferably strip-shaped fastening portion (60, 62) which interacts with a complementary, groove-shaped receiving portion (16, 18) on the fastening profile (10), wherein the two receiving portions (16, 18) on the fastening profile (10) are arranged on the fastening profile (10) on the side opposite to a fastening surface (14) for the wall (1) on the fastening profile (10), wherein the first receiving portion (16) extends at least substantially parallel to the fastening surface (14) or to abase surface portion (64) of the cladding element (50), and the second receiving portion (16) is arranged at an oblique angle (a), preferably between 50 degrees and 60 degrees, very particularly preferably about 45 degrees, to the fastening surface (14) or to the base surface portion (64).

14 Claims, 3 Drawing Sheets

(52) U.S. Cl.
CPC ..... *E04F 13/0851* (2013.01); *E04F 13/086* (2013.01); *E04F 2201/0517* (2013.01)

(58) Field of Classification Search
CPC ..... E04F 2201/0517; E04F 13/085; E04F 13/0891; E04F 13/0803; E04F 13/0889; E04F 13/0875
See application file for complete search history.

(56) References Cited

U.S. PATENT DOCUMENTS 4,344,267 A * 8/1982 Sukolics ..... E04B 1/617 52/510
4,452,029 A * 6/1984 Sukolics ..... E04B 1/617 52/510
4,829,740 A * 5/1989 Hutchison ..... E04F 19/06 52/475.1
4,833,858 A * 5/1989 Hutchison ..... E04B 1/6166 52/475.1
7,007,433 B2 * 3/2006 Boyer ..... E04C 2/292 52/592.1
7,472,521 B2 * 1/2009 Bilge ..... E04F 13/0814 52/235
7,621,084 B2 * 11/2009 Bilge ..... E04F 13/0814 52/235
7,805,899 B2 * 10/2010 Montgomery ..... E04F 13/083 52/235
8,127,507 B1 * 3/2012 Bilge ..... E04F 13/0814 52/235
8,739,483 B1 * 6/2014 Bilge ..... E04F 13/0858 52/235
8,925,271 B1 * 1/2015 Bilge ..... E04F 13/0875 52/506.05
9,051,741 B2 * 6/2015 Bilge ..... E04F 13/0891
9,328,517 B2 * 5/2016 Bilge ..... E04F 13/0889
9,328,518 B2 * 5/2016 Bilge ..... E04F 13/12
D767,793 S * 9/2016 Libreiro ..... D25/125
D767,980 S * 10/2016 Bilge ..... D8/382
D767,981 S * 10/2016 Bilge ..... D8/382
9,765,528 B2 * 9/2017 Bilge ..... E04F 13/0891
9,777,486 B1 * 10/2017 Simonsen ..... E04F 13/0814
9,850,666 B2 * 12/2017 Libreiro ..... E04F 13/0816
10,329,774 B2 * 6/2019 Koetje ..... E04F 13/0889
10,612,247 B2 * 4/2020 Simonsen ..... E04F 13/12
11,230,844 B2 * 1/2022 Simonsen ..... E04F 13/12
2004/0134143 A1 * 7/2004 Boyer ..... E04F 13/0878 52/235
2007/0022682 A1 * 2/2007 Morgenegg ..... E04B 2/90 52/235
2009/0031652 A1 * 2/2009 Ortega Gatalan .... E04F 13/083 52/235
2009/0241451 A1 * 10/2009 Griffiths ..... E04F 13/0889 52/309.4
2009/0313928 A1 * 12/2009 Montgomery ..... E04F 13/081 52/762
2012/0085042 A1 * 4/2012 Macdonald ..... E04F 13/0826 52/302.1
2012/0096799 A1 * 4/2012 Wright ..... E04F 13/0846 403/205
2014/0202094 A1 * 7/2014 Bilge ..... E04F 13/0889 52/235
2014/0202112 A1 * 7/2014 Bilge ..... E04F 13/0805 52/590.1
2014/0202113 A1 * 7/2014 Bilge ..... E04F 13/0866 403/300
2014/0223850 A1 * 8/2014 Bilge ..... E04F 13/0891 52/506.05
2015/0184372 A1 * 7/2015 Wright ..... E04F 13/0816 52/698
2015/0197940 A1 * 7/2015 Bilge ..... E04F 13/0803 52/489.2
2015/0292215 A1 * 10/2015 Bilge ..... E04F 13/0891 52/506.05
2015/0345152 A1 * 12/2015 Libreiro ..... E04F 13/12 52/800.1
2016/0273229 A1 * 9/2016 Weeks ..... E04F 13/12
2018/0016796 A1 * 1/2018 Koetje ..... E04F 13/0835
2019/0277038 A1 * 9/2019 Simonsen ..... E04F 13/12
2019/0316361 A1 * 10/2019 Koetje ..... E04F 13/0851
2020/0080316 A1 * 3/2020 Simonsen ..... E04F 13/081
2021/0040745 A1 * 2/2021 Koetje ..... E04F 13/0891
2022/0064962 A1 * 3/2022 Spodar ..... E04F 13/086
2022/0127860 A1 * 4/2022 Ratayev ..... E04F 13/0873
2022/0127862 A1 * 4/2022 Spodar ..... E04F 13/0842
2022/0145642 A1 * 5/2022 Simonsen ..... E04F 13/12
2022/0170272 A1 * 6/2022 Simonsen ..... E04B 1/7629
2023/0054911 A1 * 2/2023 Koetje ..... E04F 13/0889

FOREIGN PATENT DOCUMENTS

DE 2927164 A1 * 1/1981
DE 0201630 A2 * 11/1986
DE 102013222901 A1 5/2015
DE 102015220276 A1 * 4/2017 ..... E04F 13/0816
DE 102018106155 A1 9/2019
DE 102018126669 A1 * 4/2020 ..... E04F 13/083
EP 2053175 A1 * 4/2009 ..... E04B 9/26
EP 2930286 A2 10/2015
EP 3988737 A1 * 4/2022 ..... E04F 13/0814
FR 2949134 A1 * 2/2011 ..... E04F 13/0812
WO WO-9312307 A1 * 6/1993 ..... E04F 13/081
WO WO-2012055001 A1 * 5/2012 ..... E04F 13/0807
WO WO-2015179982 A1 * 12/2015 ..... E04F 13/0816
WO WO-2017142614 A1 * 8/2017 ..... E04F 13/0801

OTHER PUBLICATIONS

International Search Report issued by European Patent Office for International Application No. PCT/EP2019/079277 dated Jan. 24, 2020.
Written Opinion of the International Searching Authority issued by The International Bureau of WIPO for International Application No. PCT/EP2019/079277 dated Feb. 5, 2020.
International Preliminary Report on Patentability issued by The International Bureau of WIPO for International Application No. PCT/EP2019/079277 dated Apr. 27, 2021.

* cited by examiner

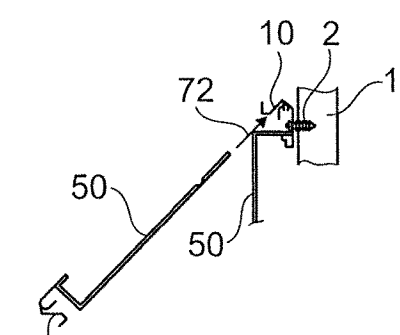
Fig. 6a
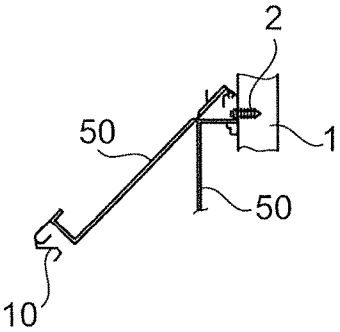
Fig. 6b
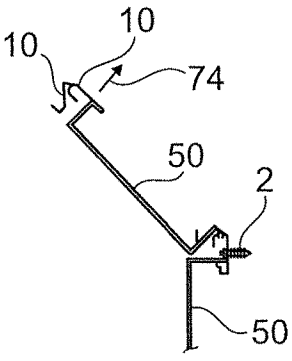
Fig. 6c
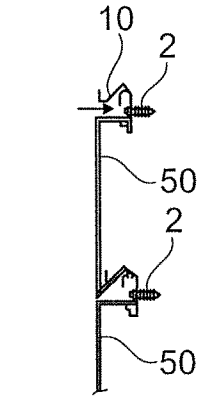
Fig. 6d
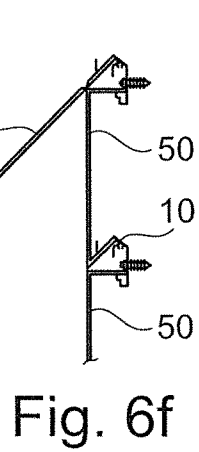
Fig. 6e
Fig. 6f
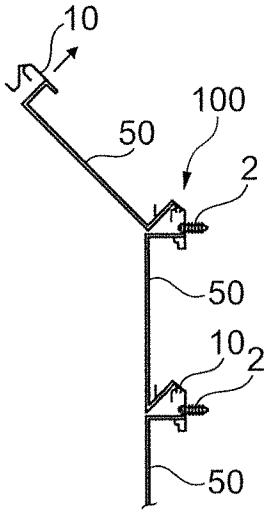
Fig. 6g
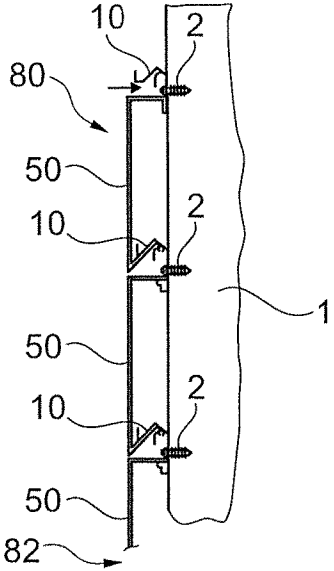
Fig. 6h

CLADDING SYSTEM FOR A WALL, ARRANGEMENT OF TILE CLADDING SYSTEM AND METHOD FOR MOUNTING THE CLADDING SYSTEM

TECHNICAL FIELD

The invention relates to a cladding system for a wall. Furthermore, the invention relates to an arrangement of a cladding system according to the invention on a wall and a method for mounting a cladding system according to the invention on a wall.

STATE OF THE ART

Various cladding systems for walls are known from the state of the art. In particular, they are used for the optical design of the wall and/or for a protection of a building wall against weather conditions or the like. The known cladding systems are normally composed of fastening elements in the form of oblong fastening profiles which can be mounted on a wall and which interact with cladding elements. The cladding elements are plate-shaped and have fastening sections, in particular on the longitudinal or transverse sides, which interact with the fastening profiles in order to connect the cladding elements to the fastening profiles. In addition to the intended optical properties of the cladding elements, a number of requirements of such a cladding system are known to guarantee the intended functionality or the protection of the wall over a long period of time. In particular, gaps between the individual cladding elements are to be as small as possible. This serves not only visual reasons, but also to minimize the ingress of moisture or dirt into the gap or spaces between the cladding elements. Additionally, the fastening profiles are anchored to the wall via screw connections, for example. Said screw connections are to be covered or disposed so as to be visually imperceptible, if applicable, by a corresponding geometric design of the cladding elements.

Subsequently published specification DE 10 2018 106 155 A1 of the applicant discloses a cladding system for a wall which is realized in a particularly advantageous manner with respect to the optical and functional design. In this realization, the individual cladding elements are anchored to the wall in the area of the longitudinal sides and of the transverse sides by means of fastening profiles.

Furthermore, the cladding system or the cladding elements are realized as sandwich components which have a core area and cover layers which are made of aluminum and cover the core area on both sides. This material has become known by the trade name ALUCOBOND® of the applicant and has already proven its worth in the worldwide use for such cladding systems. To fasten such a cladding element to a fastening profile, the specification mentioned above also discloses the creation of folding areas via groove-shaped milled slots on the cladding elements, sections used for the fastening to the fastening profile being manually bendable via the folding areas.

DISCLOSURE OF THE INVENTION

The cladding system according to the invention for a wall having the features of claim 1 has the advantage that the handling or the mounting on a wall is very easy. In particular, the cladding system according to the invention allows the mounting of the cladding system on a wall by home handymen, for example, without special knowledge of the material processing of the cladding elements and/or special tools being necessary.

The invention is based on the idea that the cladding elements are formed to the required shape which interacts with the fastening profiles at least partially by direct forming on the fastening profiles, or that the corresponding, required shaping of the cladding elements in the fastening area on the fastening profiles is ensured at the same time when the cladding elements are mounted on a wall. To this end, the cladding system according to the invention has a fastening profile for the simultaneous fastening of two cladding elements on their longitudinal or transverse sides, the fastening profile having a reception section for each of the two cladding elements, the reception section interacting with a fastening section, which is bent in relation to a base surface section of the cladding element, on the cladding element. A particularly important aspect of the invention is the arrangement of the fastening sections or of the two reception sections for the fastening sections of the cladding elements in the fastening profile in such a manner that a first fastening section of the cladding element extends at least essentially parallel to a base surface section of the cladding element and a second fastening section is disposed on the cladding element at an inclined angle, preferably between 30 degrees and 60 degrees, particularly preferably approximately 45 degrees, in relation to the base surface section. Additionally, the plane of a lateral wall surface of the second reception section assigned to the second fastening section is disposed outside the cross section of the cladding element on the fastening profile on the side which faces the reception section while the cladding element is disposed in the first reception section of the fastening profile.

Such a realization in particular allows a mounting of a cladding element when the fastening profile is already fastened to or anchored to the wall. In this process, another (second) cladding element can be inserted into the assigned reception opening of the fastening profile by its fastening section when a (first) cladding element is mounted on the wall via the first fastening section by means of the fastening profile, wherein the second cladding element is in a state in which the fastening section is still flat or is not yet formed. The folding or bending of the fastening section on the cladding element is almost necessarily realized in a subsequent mounting step, namely in the manner which is required to be able to fasten the pre-mounted cladding element to the wall.

Advantageous embodiments of the cladding system according to the invention for a wall are disclosed in the dependent claims.

The two reception sections on the fastening profile preferably have reception openings for the fastening sections which are disposed on sides of the fastening profile which face one another so that gaps in the area of the fastening profile between the individual cladding elements are as small as possible. What is more, such an arrangement also causes mounted cladding elements to block one another in a release direction, if applicable, and thus avoiding an unintended release of a cladding element from the fastening profile. This is of particular importance in connection with external forces which may occur as a result of wind forces or the like.

A preferred constructive embodiment of the fastening profile provides that the first reception section on the fastening profile has an extension on the side which faces away from the fastening surface of the fastening profile, the base surface section of the cladding element contacting the extension on the side facing the first fastening section. In addition to the reception of the first fastening section of the cladding element in the corresponding reception section of the fastening profile, such a realization also causes an additional form-fitting contact of the cladding element at the fastening profile.

To minimize the cross section or the required material of the fastening profile, the two reception sections are advantageously disposed at opposite edges of the fastening profile in relation to a transverse direction which extends perpendicular to the longitudinal direction of the fastening profile.

Preferably, the fastening or mounting of the individual cladding elements takes place by realizing an insertion slot, which serves for inserting the cladding elements into the reception sections, between the reception sections on the side of the fastening profile which faces away from the fastening surface, the insertion slot being continuous in the longitudinal direction of the fastening profile.

An embodiment of the latter proposal provides that at least one fastening screw for anchoring the fastening profile to the wall can be positioned in the area of the fastening surface and in alignment with the insertion slot, a partial length of the first fastening section disposed inside the reception section being larger than the distance between the fastening screw and a surface of a lateral wall of the cladding element facing the fastening screw and extending perpendicular to the reception opening. Such a geometric dimensioning has the particular advantage that the one cladding element received by the fastening profile is secured inside the reception section by the fastening screw when the fastening profile is mounted on the wall.

Either for optical reasons or for avoiding corrosion, another embodiment can moreover provide that the insertion slot is at least partially covered inside the cross section of the fastening profile by means of a strip-shaped cover profile.

In particular in order to realize a mounting as easy as possible of the cover profile inside the fastening profile, an embodiment of the design of the latter proposal provides that the cover profile has an L-shaped cross section and can be anchored into a reception slot of the fastening profile. With respect to the mechanical strength and a relatively low weight, the cladding element is particularly advantageously realized as a sandwich component which has a core area and cover layers which are made of aluminum and cover the core area on both sides, wherein grooves are provided at edges and are realized in the area of a cover layer and of the core area of the cladding element. The grooves at the edges cause an intended weakening of the material of the cladding element in order to be able to fold the fastening sections, in particular manually and at the intended position from the plane of the cladding element.

In particular in order to improve the corrosion properties, it is intended that the fastening profile is made of aluminum and is realized as an extruded part. The fact that the fastening profile is made of aluminum moreover also allows the particularly simple realization or arrangement of the (fastening) screws or screw openings, which are provided for the anchoring of the fastening profile to the wall, on the fastening profile during the mounting on site.

Another preferred embodiment of the fastening profile provides that said fastening profile has a section for receiving a fastening section of the cladding element, the section being used as a folding aid for the fastening section on the cladding element. It is therefore possible to insert the cladding element into the section of the fastening profile in order to fold the (first) fastening section on the cladding element and the user can thus apply the forces required for the folding of the fastening section via the base surface section in a particularly simple manner.

Furthermore, the invention comprises an arrangement of an above-described cladding system according to the invention on a wall. The arrangement according to the invention is characterized in that the second reception section is disposed above the first reception section on the fastening profile in relation to a bottom of the wall. Such an arrangement of the reception sections and therefore of the corresponding fastening sections of the cladding elements causes that an accumulation of water or dirt in the gaps between the cladding elements on the fastening profile is minimized.

To limit the weight of the individual cladding elements, in particular for reasons of handling or weight, an embodiment provides that at least three fastening profiles disposed parallel to one another and two cladding elements disposed between the fastening profiles are provided. Walls whose height is higher than the corresponding height of an individual cladding element can thus be provided with corresponding cladding elements.

Furthermore, the invention comprises a method for mounting a cladding system according to the invention as described above, the method according to the invention comprising at least the following steps: Firstly, a fastening profile is anchored to a wall. The second fastening section of a cladding element is then inserted into the reception section of the fastening profile in a state in which the second fastening section is not deformed to the base surface section of the cladding element. The base surface section is then bent to the second fastening section until the cladding element can be fixed to the wall by means of another fastening profile which is connected via the first fastening section of the cladding element. Finally, the other fastening profile is fixed to the wall.

An advantageous embodiment of the method according to the invention as described above provides that the first fastening sections are manually formed from the recently formed plane cladding elements and inserted into the first reception sections of the fastening elements before the second fastening sections are formed on the fastening profiles. For this purpose, as described above, the additional sections provided in the fastening profiles in particular can be used as a folding aid.

An alternative method for mounting a cladding system according to the invention on a wall provides that the fastening sections are formed on a cladding element before the connection with the fastening profile. Such a method is particularly advantageous if relatively large or heavy cladding elements are provided which are relatively difficult to handle (on the wall). In this case, the alternative method provides that at least the following steps are performed: Firstly, a first and second fastening section are formed on a plane cladding element. A fastening profile is then anchored to the wall and a formed first or second fastening section is inserted into an assigned reception section of the fastening profile. Alternatively, a formed first or second fastening section is inserted into an assigned reception section of a fastening profile in a state in which the fastening profile is not yet fastened to the wall and the fastening profile is subsequently fastened to the wall. As the next step, the other formed fastening section is inserted into another fastening profile in a state in which the additional fastening profile is not yet connected to the wall. Finally, the other fastening profile is fixed to the wall.

Further advantages, features and details of the invention are apparent from the following description of preferred exemplary embodiments and from the drawing.

IN THE DRAWING

Figure 2:
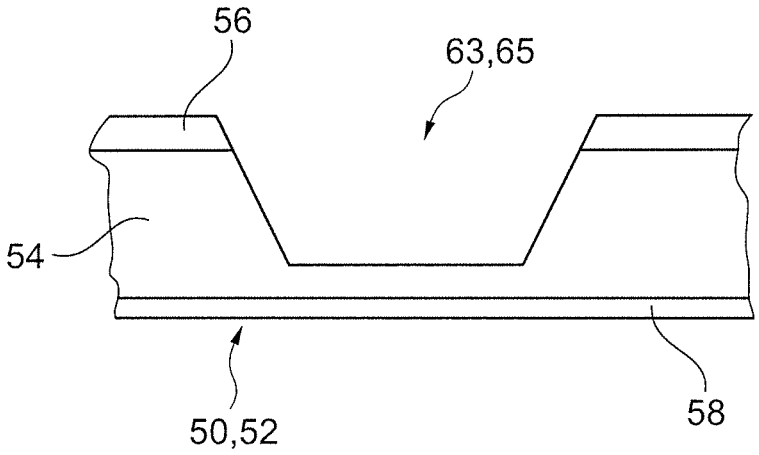
Figure 5:
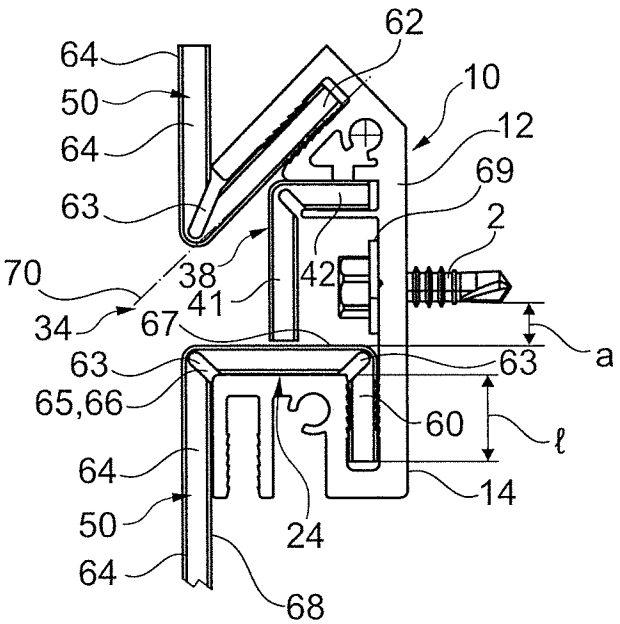
Figure 4:
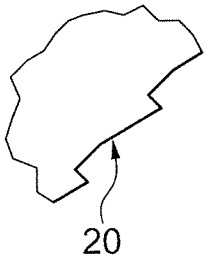
Figure 3:
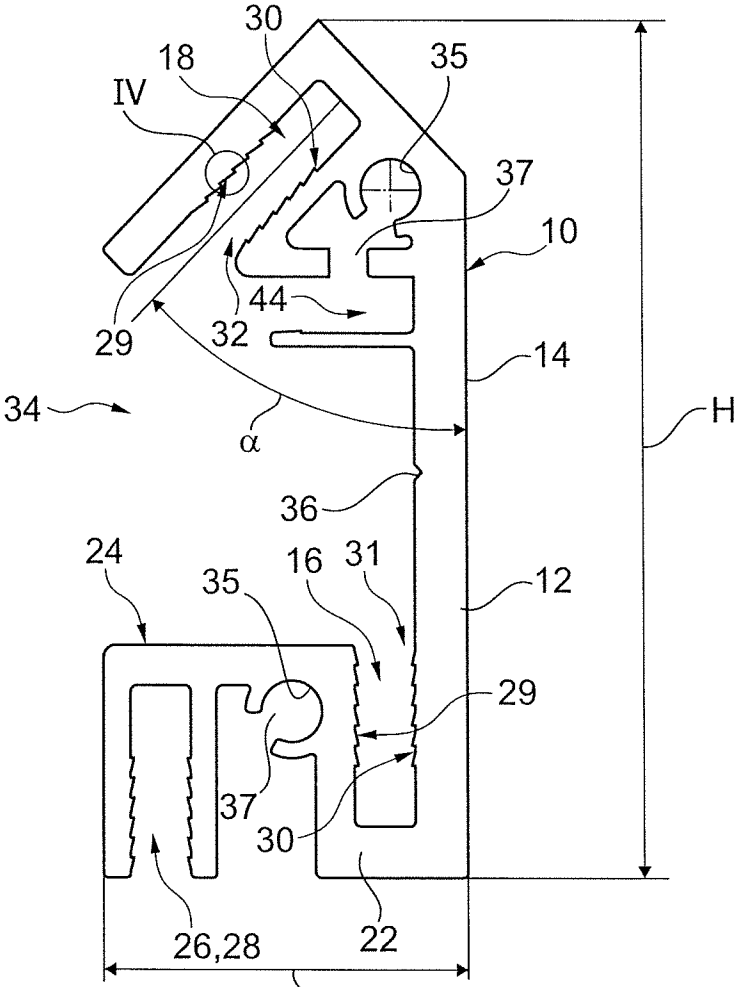

FIG. 1 shows a top view of a cladding element having a rectangular base surface, FIG. 2 shows a cross section of a cladding element in a folding area, FIG. 3 shows a cross section of a fastening profile, FIG. 4 shows an enlarged view of a detail of FIG. 3, FIG. 5 shows the fastening profile according to FIG. 3 having two mounted cladding elements and FIG. 6*a* to FIG. 6*h* show the mounting of cladding elements on a wall by means of the fastening profile in a first mounting method.

In the figures, the same elements or elements having the same function are referenced with the same reference numerals.

The figures show a cladding system 100 for covering a wall 1 (for reasons of simplification, only FIGS. 6*a*, 6*b* and 6*h* show wall 1). Wall 1 is a building wall or a garage wall, for example. Cladding system 100 is substantially composed of a plurality of fastening profiles 10 which interact with (flat) cladding elements 50, wherein cladding elements 50 are connected to fastening profiles 10 and fastening profiles 10 in turn can be anchored into wall 1 by means of fastening screws 2.

In a top view, cladding element 50 shown in a detail view in FIG. 1 preferably has a rectangular shape and is realized as a sandwich component 52. According to the illustration of FIG. 2, the composition of sandwich component 52 or of cladding element 50 is composed of a core area 54 and cover layers 56, 58 which are made of aluminum and cover core area 54 on both sides. Such a sandwich material as described above has become known by the name ALUCOBOND® of the applicant and is particularly characterized by a relatively low weight and good strength properties.

On its two opposite longitudinal sides or transverse sides, cladding element 50 has a first fastening section 60 and a second fastening section 62 which are each strip-shaped. The two fastening sections 60, 62 are connected in a monolithic manner to base surface section 64 of cladding element 50 via straight edge areas 63, base surface section 64 being plane and rectangular in the exemplary embodiment. According to the view of FIG. 2, grooves 65 are realized at edges 63, the material of one cover layer 56 and of core area 54 being removed from the area of grooves 65. Additionally, first fastening section 60 has another edge 66 comprising another groove 65, edge 66 being parallel to edge 63.

Additionally, it is mentioned that base surface section 64 of cladding element 50 is plane in the shown exemplary embodiment. However, it is also conceivable to design base surface section 64 in a three-dimensional manner by providing beads or edges, for example, to be able to achieve desired effects of cladding element 50 which are intended for reasons of strength or for optical reasons, for example. Additionally, cladding elements 50 do not have to realize a shared plane surface when said cladding elements 50 are fastened to wall 1. Instead, cladding elements 50 which are inclined in relation to wall 1 can be provided by providing fastening sections 60, 62 in different widths in order realize a three-dimensional wall design.

Cladding elements 50 are preferably manufactured by the manufacturer of cladding elements 50 in standardized sizes having a width between 1 m and 2 m, for example, in the direction of fastening sections 60, 62 and a length between 2.5 m and 3.5 m extending perpendicular to the width and are already provided with grooves 65 or fastening sections 60, 62. Additionally, cladding elements 50 are preferably delivered or transported by the manufacturer of cladding elements 50 to the mounting location on wall 1 in the plane state of fastening sections 60, 62, i.e., in a state in which fastening sections 60, 62 are not folded from the plane of base surface section 64. This is done in particular with respect to the space requirement which needs to as small as possible during the transport of such cladding elements 50.

Fastening profile 10, which is clearly visible in FIGS. 3 and 5, is made of aluminum and is realized as an extruded part. It is strip-shaped and has an exemplary width B of approximately 30 mm and a height H of approximately 65 mm, the longitudinal direction of fastening profile 10 extending perpendicular to the drawing layer of FIGS. 3 and 5. Preferably, the length of fastening profile 10 corresponds to the length of fastening sections 60, 62. Fastening profile 10 has a (plane) base surface section 12 which realizes a (plane) fastening surface 14 on the side which faces wall 1. In a transverse direction which is perpendicular to the longitudinal direction of fastening profile 10, fastening profile 10 has reception sections 16, 18 at opposite edges for receiving a first fastening section 60 or a second fastening section 62 of two cladding elements 50.

Just like second reception section 18 assigned to second fastening section 62, first reception section 16 assigned to first fastening section 60 on fastening profile 10 is groove-shaped and extends in the longitudinal direction of fastening profile 10, i.e., perpendicular to the drawing layer of FIGS. 3 and 5. As in particular shown in the illustration of FIGS. 3 and 4, reception sections 16, 18 which interact with fastening sections 60, 62 in a form-fitting manner can be provided with a saw-tooth-like structure 20 on lateral surfaces 29, 30 which face fastening sections 60, 62, structure 20 causing fastening sections 60, 62 to claw into reception sections 16, 18, in particular if a force is applied to fastening sections 60, 62 against the insertion direction into reception sections 16, 18.

First reception section 16 extends at least substantially parallel to base surface section 12 or to fastening surface 14 on the side of base surface section 12 which faces away from fastening surface 14. In this context, base surface section 12 itself realizes one of the lateral walls 30 of first reception section 16. A second lateral wall 29 of first reception section 16 is realized by an extension 24 which is formed onto base surface section 12 via a transverse wall section 22. Furthermore, extension 24 has another section 26 for receiving first fastening section 60 of a cladding element 50, section 26 being used as a mounting or folding aid 28 for folding first fastening section 60 on cladding element 50.

Second reception section 18 on fastening profile 10 extends at an inclined angle $\alpha$ between 30° and 60°, preferably approximately 45°, in relation to the plane of base surface section 12 or of fastening surface 14. The two reception sections 16, 18 each have a reception opening 31, 32 for respective fastening section 60, 62, the two reception openings 31, 32 being disposed on sides facing one another on fastening profile 10.

Fastening profile 10 has a continuous insertion slot 34 between both reception sections 16, 18, the insertion slot 34 extending in the longitudinal direction of fastening profile 10 and serving for inserting respective fastening section 60, 62 of respective cladding element 50 into corresponding reception section 16, 18.

Additionally, the cross section of fastening profile 10 has one channel 35 near both of the two reception sections 16, 18, respectively, channel 35 having an additional longitudinal slot 37 and extending in the longitudinal direction.

Channel 35 is used for the fixation of cladding elements 50 by means of additional fastening elements (not shown) in an arrangement on wall 1 in which fastening sections 60, 62 extend in a vertical direction in relation to wall 1.

As in particular shown in FIG. 3, base surface section 12 has a groove-shaped recess 36 in central alignment with insertion slot 34, recess 36 extending in the longitudinal direction and preferably being disposed in an approximately central area of fastening profile 10 in relation to the transverse direction of fastening profile 10. Recess 36 is used for the localization or marking of the position at which fastening profile 10 can be connected to wall 1 by means of at least one fastening screw 2 (shown in FIG. 5). Such a recess 36 can in particular be used as a drilling aid for realizing a corresponding through bore on fastening profile 10, so that fastening screw 2 can be mounted in a subsequent step.

According to FIG. 5, the invention can moreover provide that insertion slot 34 is at least partially closed or covered inside the cross section of fastening profile 10 by a cover profile 38. In this regard, it is particularly useful to cover fastening screws 2 by cover profile 38 as well; in this way, fastening screws 2 cannot be optically detected and a particularly good protection of fastening screws 2 against moisture or the like is enabled at the same time. Cover profile 38 has an L-shaped cross section, a first leg 41 of cover profile 38 extending parallel to fastening surface 14 or to base surface section 12 and second leg 42 disposed at right angles to first leg 41 engaging into a reception slot 44 of fastening profile 10 and being anchored there.

As FIG. 5 shows, the two base surface sections 64 of the two cladding elements 50 disposed on a fastening profile 10 realize a shared plane; this means, for example, that base surface sections 64 are disposed at the same distance from and parallel to base surface section 12 of fastening profile 10. As explained above, however, this is not necessarily required.

The illustration of FIG. 5 further shows that cladding element 50, which is connected to fastening profile 10 via first fastening section 60, flushes with extension 24 via back 68 of base surface section 64 which faces fastening profile 10.

An essential aspect of the arrangement or realization of, in particular, second reception section 18 on fastening profile 10 is that, according to the illustration of FIG. 5, in a state in which the two cladding elements 50 are received in reception sections 16, 18 via fastening sections 60, 62, a plane 70 aligning with lateral surface 30 in second reception section 18 extends outside the cross section of cladding element 50 disposed in first reception section 16. When cladding element 50 is already disposed on fastening profile 10 via first fastening section 60, such an arrangement allows an insertion of second fastening section 62 of other cladding element 50 into second reception section 18 of fastening profile 10 in a state in which second fastening section 62 is in a plane with base surface section 64, i.e. is not yet folded from base surface section 64.

FIG. 5 further shows that partial length I of first fastening section 60 disposed in first reception section 16 is larger than distance a between a lateral wall 67 of cladding element 50 facing fastening screw 2 and fastening screw 2 or a washer 69 interacting with fastening screw 2. Lateral wall 67 is disposed between first fastening section 60 and base surface section 64, lateral wall 67 extending at a right angle to first fastening section 60.

The mounting of fastening profiles 10 and cladding elements 50 on wall 1 is explained below on the basis of the figure sequence of FIGS. 6*a* to 6*h*. FIG. 6*a* shows a state in which a fastening profile 10 is already mounted on wall 1 by means of at least one fastening screw 2. Furthermore, the figure shows a (lower) cladding element 50 which is already mounted on fastening profile 10 and which is connected to fastening profile 10 by means of its first fastening section 60. According to the illustration of FIG. 6*a*, the other or upper (in relation to fastening profile 10 which is already mounted) cladding element 50 is then mounted in the direction of arrow 72, i.e., in second reception section 18 of fastening profile 10, in a state in which second fastening section 62 is not yet folded or extends in the plane of base surface section 64.

FIG. 6*b* shows the state in which second fastening section 62 is disposed in second reception section 18 of fastening profile 10. According to the illustration of FIG. 6*c*, inserted cladding element 50 is then folded by moving cladding element 50 in the direction of arrow 74, second fastening section 62 thus being formed by deformation at edge 66.

Furthermore, FIGS. 6*a* to 6*c* also show that another fastening profile 10 is already fastened to cladding element 50 to be mounted at this point. The folding of first fastening section 60 of said cladding element 50 can be performed in advance on a fastening profile 10 fastened to wall 1 by inserting first fastening section 60 into section 26.

FIG. 6*d* shows a state in which cladding element 50 has reached its final position on wall 1 and is anchored to wall 1 via fastening profile 10 by means of at least one additional fastening screw 2. In the figure sequence of FIGS. 6*e* to 6*h*, the mounting processes described above are repeated.

FIG. 6*h* shows an arrangement 80 which comprises several cladding elements 50 which are disposed above one another in relation to a bottom 82 of wall 1. It is essential that second reception sections 18 or second fastening sections 62 of a cladding element 50 anchored to a fastening profile 10 are always disposed above the other, first fastening sections 60 or first reception section 16 disposed on corresponding fastening profile 10.

It is also mentioned that the mounting of cover profile 38 is performed after the fastening of a fastening profile 10 to wall 1 and before the insertion of a second fastening section 62 of another cover element 50 into corresponding second reception section 18 of fastening profile 10.

Cladding system 100 for a wall 1 as described above can be adapted or modified in many ways without departing from the idea of the invention.

REFERENCE SIGNS s

1 wall
2 fastening screw
10 fastening profile
12 base surface section
14 fastening surface
16 first reception section
18 second reception section
20 structure
22 transverse wall section
24 extension
26 section
28 mounting or folding aid
29 lateral surface
30 lateral surface
31 reception opening
32 reception opening
34 insertion slot
35 channel
36 recess

37 longitudinal slot
38 cover profile
41 first leg
42 second leg
44 reception slot
50 cladding element
52 sandwich component
54 core area
56 cover layer
58 cover layer
60 first fastening section
62 second fastening section
63 edge
64 base surface section
65 groove
66 edge
67 lateral wall
68 back
69 washer
70 plane
72 arrow
74 arrow
80 arrangement
82 bottom
100 cladding system
B width
H height
I partial length
a distance
α angle

The invention claimed is:

1. A cladding system for a wall comprising
a cladding element comprising:
a first fastening section;
a second fastening section; and
a base surface section disposed between the first fastening section and the second fastening section; and
a fastening profile configured to receive the cladding element, the fastening profile comprising:
a first reception section;
a second reception section; and
a fastening surface disposed between the first reception section and the second reception section and configured to be secured to the wall, wherein the first reception section extends at least substantially parallel to the fastening surface and the second reception section extends at an inclined angle between approximately 30 degrees and approximately 60 degrees with respect to the fastening surface;
wherein the first fastening section of the cladding element is configured to be bent in at least two places in relation to the base surface section so as to form a first bent portion and a second bent portion;
wherein the second fastening section of the cladding element is configured to be bent in relation to the base surface section;
wherein the first fastening section of the cladding element is configured to be received by the first reception section of the fastening profile such that one of the first or second bent sections is disposed parallel to the fastening surface of the fastening profile and the second fastening section is configured to be received by a second reception section of a second fastening profile; and
characterized in that the fastening profile is made of aluminum and is realized as an extruded part.

2. A method for mounting a cladding system according to claim 1 on the wall, the method comprising at least the following steps:
anchoring the fastening profile to the wall;
inserting the second fastening section of the cladding element into the second reception section of the fastening profile in a state in which the second fastening section is not deformed to the base surface section of the cladding element;
bending the base surface section to the second fastening section until the cladding element is fixed to the wall by means of another fastening profile which is connected to the first fastening section of the cladding element; and
fixing the other fastening profile to the wall.

3. The cladding system according to claim 1, characterized in that the first and second reception sections of the fastening profile have reception openings for the first and second fastening sections, the reception openings being disposed on sides of the fastening profile facing one another.

4. The cladding system according to claim 1, characterized in that
the first reception section on the fastening profile has an extension on the side which faces away from the fastening surface, such that in an installed configuration the base surface section of the cladding element contacts the extension on the side facing the first fastening section.

5. The cladding system according to claim 1, characterized in that the two reception sections are disposed at opposite edges of the fastening profile in relation to a transverse direction which extends perpendicular to the longitudinal direction of the fastening profile.

6. The cladding system according to claim 1, characterized in that an insertion slot for inserting the cladding elements into the first and second reception sections is realized between the first and second reception sections on the side of the fastening profile which faces away from the fastening surface, the insertion slot being continuous in the longitudinal direction of the fastening profile.

7. The cladding system according to claim 6, characterized in that at least one fastening screw for anchoring the fastening profile to the wall is positioned in the area of the fastening surface and in alignment with the insertion slot, and in that a partial length of the first fastening section disposed inside the first reception section is larger than the distance between the fastening screw and a lateral wall of the cladding element which faces the fastening screw and which extends perpendicular to the reception section.

8. The cladding system according to claim 6 characterized in that the insertion slot is at least partially covered inside the cross section of the fastening profile by means of a strip-shaped cover profile.

9. The cladding system according to claim 8, characterized in that the cover profile has an L-shaped cross section and is anchored in a reception slot of the fastening profile.

10. The cladding system according to claim 1, characterized in that the cladding element is realized as a sandwich component which has a core area and cover layers which are made of aluminum and cover the core area on both sides, and in that grooves are provided at edges and are realized in the area of a cover layer and of the core area.

11. The cladding system according to claim 1, characterized in that the fastening profile has a section for receiving the first fastening section of the cladding element as a folding aid for the first fastening section.

12. An arrangement of a cladding system according to claim 1 on a wall, characterized in that the second reception section of the fastening profile is disposed above the first reception section in relation to a bottom of the wall.

13. The arrangement according to claim 12, characterized in that at least three fastening profiles disposed parallel to one another and two cladding elements disposed between the fastening profiles are provided.

14. A cladding system for a wall comprising:

a cladding element comprising:

a first fastening section;

a second fastening section; and a base surface section disposed between the first fastening section and the second fastening section; and a fastening profile configured to receive the cladding element, the fastening profile comprising:

a first reception section;

a second reception section; and a fastening surface disposed between the first reception section and the second reception section and configured to be secured to the wall, wherein the first reception section extends at least substantially parallel to the fastening surface and the second reception section extends at an inclined angle between approximately 30 degrees and approximately 60 degrees with respect to the fastening surface;

wherein the first fastening section of the cladding element is configured to be bent in at least two places in relation to the base surface section so as to form a first bent portion and a second bent portion;

wherein the second fastening section of the cladding element is configured to be bent in relation to the base surface section;

wherein the first fastening section of the cladding element is configured to be received by the first reception section of the fastening profile such that one of the first or second bent sections is disposed parallel to the fastening surface of the fastening profile and the second fastening section is configured to be received by a second reception section of a second fastening profile; and characterized in that the first reception section on the fastening profile has an extension on the side which faces away from the fastening surface, such that, in an installed configuration, the base surface section of the cladding element contacts the extension on the side facing the first fastening section.

* * * * *